US009096913B2

(12) United States Patent
Lang et al.

(10) Patent No.: US 9,096,913 B2
(45) Date of Patent: Aug. 4, 2015

(54) PROCESS AND SYSTEM FOR CREATING INTERNAL STRESS IN A METALLIC WORKPIECE

(75) Inventors: Roland Lang, Woerth (DE); Eggert Reese, Oberpframmern (DE); Juergen Steinwandel, Uhldingen-Muehlhofen (DE)

(73) Assignee: EADS Deutschland GmbH, Ottobrunn (DE)

( * ) Notice: Subject to any disclaimer, the term of this patent is extended or adjusted under 35 U.S.C. 154(b) by 1348 days.

(21) Appl. No.: 12/275,668

(22) Filed: Nov. 21, 2008

(65) Prior Publication Data

US 2009/0134130 A1 May 28, 2009

(30) Foreign Application Priority Data

Nov. 22, 2007 (DE) ..... 10 2007 056 502

(51) Int. Cl.
*B23K 26/00* (2014.01)
*C21D 10/00* (2006.01)

(52) U.S. Cl.
CPC ..... *C21D 10/005* (2013.01)

(58) Field of Classification Search
USPC ..... 219/121.66, 121.85, 121.69, 121.65, 219/121.61, 121.62, 121.76, 121.77, 121.6; 148/125; 372/128
See application file for complete search history.

(56) References Cited

U.S. PATENT DOCUMENTS

| | | | | |
|---|---|---|---|---|
| 5,131,957 | A * | 7/1992 | Epstein et al. | 148/565 |
| 5,911,891 | A * | 6/1999 | Dulaney et al. | 219/121.85 |
| 5,932,120 | A * | 8/1999 | Mannava et al. | 219/121.85 |
| 2004/0224179 | A1 * | 11/2004 | Sokol et al. | 428/610 |
| 2005/0218122 | A1 * | 10/2005 | Yamamoto et al. | 219/121.61 |
| 2006/0124619 | A1 * | 6/2006 | Mannava et al. | 219/121.85 |

FOREIGN PATENT DOCUMENTS

| | | | | |
|---|---|---|---|---|
| EP | 0 933 438 | A1 | 8/1999 | |
| EP | 1 122 321 | A2 | 1/2001 | |
| EP | 1 122 321 | A2 | 8/2001 | |
| EP | 1 188 842 | A1 | 3/2002 | |
| EP | 1 669 466 | A1 | 6/2006 | |
| EP | 1 852 615 | B1 | 11/2007 | |
| EP | 1852515 | A1 * | 11/2007 | C21D 10/00 |
| WO | WO 95/25821 | | 9/1995 | |
| WO | WO 95/25821 | A1 | 9/1995 | |

OTHER PUBLICATIONS

P. R. Smith, et al., "Effect of Power Density and Pulse Repetition on Laser Shock Peening of Ti-6Al-4V", Journal of Materials Engineering and Performance, Feb. 2000, pp. 33-37, vol. 9, No. 1, ASM International.

(Continued)

*Primary Examiner* — Thien S Tran
(74) *Attorney, Agent, or Firm* — Crowell & Moring LLP

(57) ABSTRACT

A process and a system for creating internal stress in a metallic workpiece by laser shock peening is provided. In the process, a first laser pulse is applied to a treatment site of the workpiece covered by a surface layer. A second laser pulse follows the first laser pulse in time, and is applied to the treatment site of the workpiece. A covering layer, such as flowing water, is provided over the treatment site during the application of the laser pulses.

17 Claims, 1 Drawing Sheet

(56) References Cited

OTHER PUBLICATIONS

Kan Ding, et al., "Simulation of multiple laser shock peening of a 35CD4 steel alloy", Journal of Materials Processing Technology, 2006, pp. 162-169, Elsevier.

J. Fournier, et al., "Mechanical Effects Induced by Shock Waves Generated by High Energy Laser Pulses", Journal de Physique, Sep. 1991, pp. 1467-1480, No. 9, J. Phys. France.

European Search Report including English translation dated Mar. 13, 2009 (Eight (8) pages).

* cited by examiner

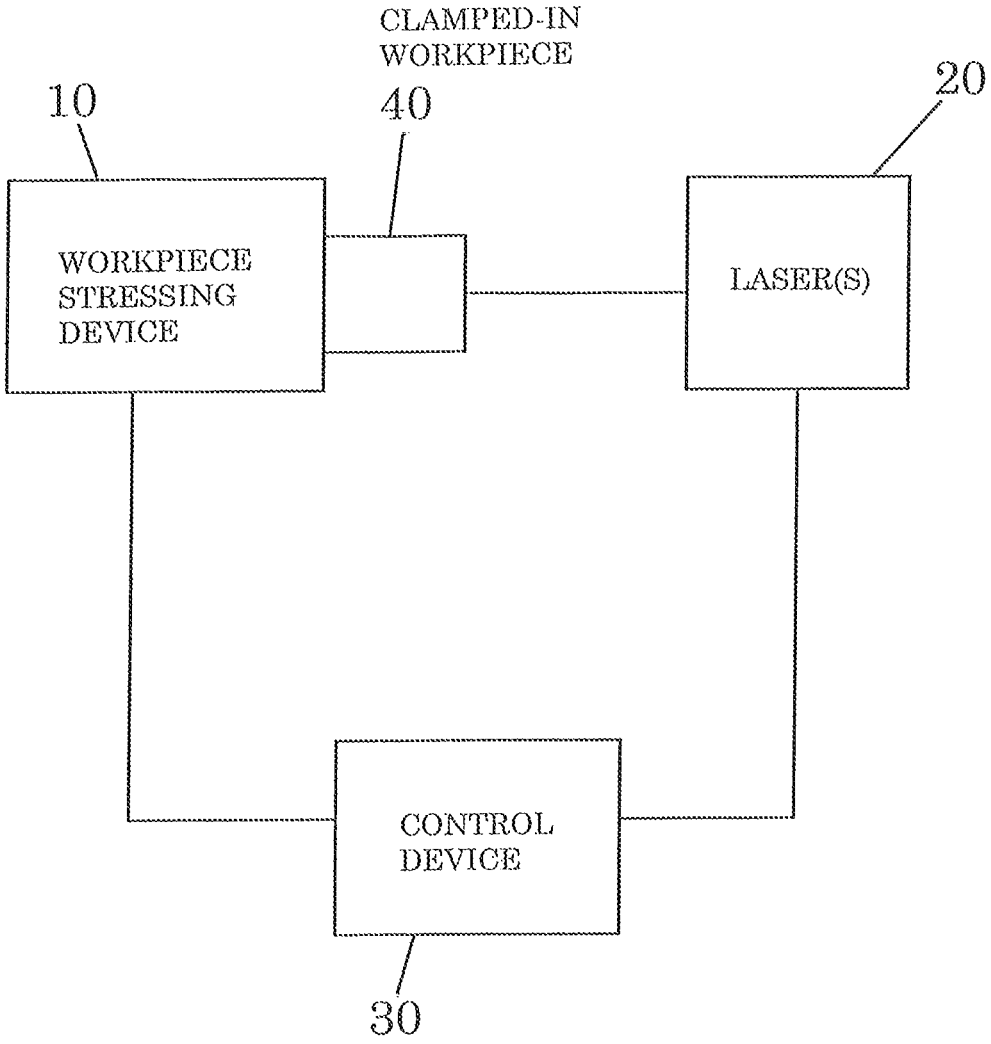
CLAMPED-IN
WORKPIECE
10
40
20
WORKPIECE
STRESSING
DEVICE
LASER(S)
CONTROL
DEVICE
30

PROCESS AND SYSTEM FOR CREATING INTERNAL STRESS IN A METALLIC WORKPIECE

RELATED APPLICATION

This application claims priority under 35 U.S.C. §119 to German Patent Application no. DE 10 2007 056 502.1, which was filed Nov. 22, 2007, the entire disclosure of which is incorporated by reference herein.

BACKGROUND AND SUMMARY OF THE INVENTION

The invention relates to a process and a system for creating internal stress in a metallic workpiece by laser shock peening (LSP).

Laser shock peening is a process by which internal stress can be created in a metallic workpiece with a pulsed laser beam. Internal stress in the metallic workpiece is often desired because it can prevent fatigue or crack propagation when the workpiece is loaded.

Conventionally, in this case, the material to be treated is acted upon by an ablative surface layer before laser shock peening. The surface layer is formed, for example, by a metal coating, a metal foil or is made of organic materials. When the pulsed laser beam acts upon this surface layer, the surface layer evaporates and is changed into the plasma condition (state of ionization). Simultaneously with the application of the laser pulse, a covering layer is generated over the treatment site, which covering layer is formed, for example, by flowing water. This covering layer contributes to the fact that the transient plasma formed by the effect of the laser beam on the surface layer is spatially fixed for a time period corresponding approximately to the pulse duration. However, this quasi balanced condition is breached by the plasma pressure so that the covering layer can no longer withstand the plasma pressure and the plasma expands freely. In the process, dynamic impulses are transmitted to the surface of the workpiece which are caused by shock waves which, in turn, lead to the induction of internal stress in the workpiece.

In this case, the laser pulse with an energy of, for example, 5 to 50 J is used for the evaporation of the surface layer as well as for the plasma formation. The used laser beams conventionally have a pulse duration of from 10 to 50 nanoseconds (nsecs).

As required and depending on the workpiece configuration, such a laser impulse is applied to the workpiece at various sites in a spatially offset, simultaneous or time-staggered manner in that, for example, the workpiece and the laser generating device are moved relative to one another and, in each case, identical laser impulses act upon various sites on the workpiece.

Thus, a single laser pulse always acts upon one site, which laser pulse is sufficiently energetic (by controlling the laser pulse energy as well as the pulse duration) that it results in the production and propagation of the plasma and that the induced solid-state shock wave has a sufficiently high shock intensity so that the plastic yield point in the workpiece is exceeded and internal stress is thereby created in the metallic workpiece. The process is used mainly for creating compressive internal stress on surface areas, i.e., in depths of up to 10 mm, for protecting against stress crack corrosion but also for the purpose of deformation.

Accordingly, one object of the invention to provide a process and a device system for creating internal stress in a metallic workpiece using laser shock peening (LSP), which process improves the utilization of the energy of the laser beam and thereby results in more targeted and stronger shock waves in the workpiece, which shock waves, in turn, cause the induction of internal stress.

BRIEF DESCRIPTION OF THE DRAWING

Features and advantages of the present invention will become apparent to those skilled in the art from the following description with reference to the drawing, in which:

The FIGURE shows a system according to certain embodiments of the invention.

DESCRIPTION OF PREFERRED EMBODIMENTS OF THE INVENTION

A first laser pulse is applied to a treatment site of the workpiece covered by a surface layer. A second laser pulse, which is time staggered relative to the first laser pulse, is applied to the treatment site of the workpiece. A covering layer over the treatment site during the application of the laser pulses is provided.

FIG. 1 depicts an embodiment of a system including a workpiece stressing device 10 is provided by the invention. The system includes at least one laser 20 and a control device 30 for controlling the relative movement between a clamped-in workpiece 40 and the laser 20. The control device 30 is adapted for controlling the process using different embodiments of the invention.

An objective of the invention involves applying to one and the same treatment site of the workpiece at least two time-staggered laser pulses, as required, with a short pause without any laser pulse action between the staggered laser pulses. As a result, the energy fed by the laser beam can be adjusted in a targeted manner to the physical processes occurring in the surface layer so that, for example, the first pulse causes the evaporation or ablation of the absorbing layer and a pre-plasma is formed which has a low ionization. In this example, the second laser pulse can be controlled in such a manner energetically that it causes the formation of a fully developed, quasi-static plasma, which is a non-balanced state with high ionization, and also leads to the expansion of the plasma through the covering layer and thereby to the induction of internal stress in the workpiece.

In this case, the time-staggered laser pulses affecting the same treatment site are preferably characterized by different energy. When using two staggered pulses, the second pulse preferably is significantly higher with respect to energy than the first pulse. Accordingly, the first pulse can be a low energy pulse. This first pulse causes the evaporation, for which a significantly lower energy is required than for the subsequent formation and expansion of an unsteady plasma with a comparatively high enthalpy. The relatively high energy of the second laser pulse, which is required for the later conversion of the plasma energy to predominantly energetic flow enthalpy, is utilized very well and is predominantly used for the conversion and expansion process of the unsteady plasma, without the occurrence of massive radiation losses or considerable (unnecessary) temperature increases. Also, when more than two laser pulses are used, in each case, the laser pulse intended for the formation and expansion of the unsteady plasma should have relatively high energy. The evaporation process and the plasma heating process are thereby uncoupled with respect to time, so that the energetic utilization of the laser impulses is improved and the effect on the workpiece is more targeted.

In addition, as a result of the double or multiple pulse excitation, the slightly ionized primary plasma is produced by an, at first, relatively moderate energy use. However, this primary plasma condition has a high absorption capacity for the radiation of the secondary laser pulse, so that a much higher fraction of the incident laser radiation can be effectively converted to plasma enthalpy than is possible in the case of a conventional single-pulse excitation. The resulting losses by reflection, the passage of the laser pulses in an unutilized manner to the metal surface by way of an initially optically thin plasma as well as by convention and also radiation can thereby be minimized.

The interval between laser pulses is, for example, 5 to 100 nsecs.

It is possible for the laser pulses to immediately, i.e., without any time-related staggering, follow one another. However, it is preferred to provide a time period of from 5 to 100 nsecs between the laser pulses because then, as a result of a corresponding coordination of the laser pulses, as well as of the time interval and the number of laser pulses, a targeted effect can be achieved on the individual processes occurring during the formation of the plasma and in the plasma. Each laser pulse can be adapted to a certain condition of the plasma.

Preferably, the pulse forms of the time-staggered laser pulses are also different. In particular, the laser pulses preferably have different leading-edge shapes. As a result, in addition to the control of the energy of the laser pulses by their width (with respect to time), which may each be different or identical, the selection of a suitable leading edge may also have a targeted effect on the energetic processes.

Preferably, the different energetic conditions of the laser pulses having a staggered effect are generated by their time-related width and/or energy.

According to a preferred embodiment, more than two time-staggered laser pulses are applied to the same treatment site and have their effect there. In this case, the energetic control is even more favorable.

As in the case of the conventional single-pulse process, in the case of double-pulse or multiple-pulse processes according to the invention, flowing water can be used as a covering layer. This is a covering layer that can be produced in a relatively cost-effective manner and can easily be disposed of.

The time-staggered laser pulses can be provided by a single laser or by a laser that differs for each laser pulse. Especially in the case of the preferred use of several machining lasers, it is easily possible to represent different pulse forms, different energies for the pulses, etc., for generating the staggered laser pulses. However, even when several machining lasers are used, these act upon the same machining site at the workpiece in a time-staggered manner.

The process, which preferably also contains the step of applying the surface layer to be evaporated before the first laser pulse is applied, which surface layer is produced, for example, by metal coating, application of a metal foil or application of organic material, as required and depending on the workpiece into which the internal stress is to be entered or on which the deformation is to be generated, can be repeated at several sites of the workpiece in order to achieve, for example, a larger-surface solidification, in which case, however, a double or multiple pulse acts upon each site.

During laser shock peening, it is necessary that a primary plasma enthalpy be achieved that is as high as possible for a time period in which the plasma is largely stabilized by the covering layer, such as flowing water. Use of a single laser pulse is not optimal for the evaporation of the ablation material in addition to producing a transient high-pressure plasma (with peak pressures of up to over 10 bar), because of energy requirement differentials for the evaporation and primary plasma production, when compared with the subsequent formation of an unsteady plasma with a comparatively high enthalpy.

Specifically, in the primary plasma phase, a certain impulse transmission to the workpiece already takes place by way of unsteady pressure. This can already induce primary compression shocks. However, this process is not easily controllable or effective and is not suitable for creating significant and targeted internal compressive stress. The actual phase of the induction of internal compressive stress starts with the expansion of the plasma (the flowing plasma) after the quasi-static initial phase, in which the covering layer limits the expansion. When the covering layer is breached, a supersonic plasma flow is produced whose retroactive dynamic impulse triggers the shock wave which deforms the workpiece, particularly its metallic material, beyond the plastic yield point and thereby leaves internal compressive stress also after the drop of the plasma and relaxation.

This process is more effective with the higher original enthalpy (defined by pressure and temperature) of the primary plasma, and its ability to be changed to kinetic flow enthalpy, which takes place in the phase of the expanding and rapidly flowing plasma breaching the covering layer.

The individual processes during laser shock peening comprise the stages of primary evaporation (ablation) of the absorbing layer; formation of a pre-plasma that is slightly ionized, formation of a fully formed, quasi-static plasma which is an unbalanced condition with a high ionization, and expansion of the plasma through the covering layer.

By the application of at least two time-staggered pulses to the same workpiece site, transfer of laser energy into the plasma condition in the expansion phase is avoided. Such energy transfer is not desirable because the processes have different time-related development phases, and the energy entered into the plasma condition in the expansion phase is not converted to kinetic energy (for forming the fully developed, quasi-static plasma) but is converted, for example, to temperature and radiation energy and thus results in a loss of energy.

It is therefore useful to provide an interval of from 5 to 100 nsecs between the individual laser pulses, so that the time-related change of the forming plasma into the individual stages can take place without energy at points in time at which it cannot be converted, and, in addition, the energy of the laser pulses can be defined in a manner that is adapted to the most recent occurring partial process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A process for creating internal stress in a metallic workpiece by laser shock peening, comprising the steps of:

forming a slightly ionized pre-plasma by applying a first laser pulse, having a first energetic condition, to a treatment site of the workpiece covered by a surface layer to evaporate a portion of the surface layer and form the slightly ionized pre-plasma, forming a quasi-static plasma from the slightly ionized pre-plasma by applying a second laser pulse, having a second energetic condition, wherein the second laser pulse has an energy level that is higher than an energy level of the first laser pulse, and the second laser pulse is applied to the treatment site of the workpiece at an interval of from 5 nsecs to 100 nsecs after the first laser pulse, and providing a covering layer over the treatment site during the application of the laser pulses, wherein the first energetic condition is one that forms the slightly ionized pre-plasma without forming the quasi-static plasma, wherein the first energetic condition is insufficient to form plasma and cause expansion of an unsteady plasma, and wherein the second energetic condition is one that forms the quasi-static plasma from the slightly ionized pre-plasma.

2. A process according to claim 1, wherein the laser pulses have respective leading edges with different properties.

3. A process according to claim 2, wherein the properties are leading-edge shapes.

4. A process according to claim 1, wherein the first and second energetic conditions involve a duration of the laser pulses and the first and second pulses have different durations.

5. A process according to claim 1, wherein more than two laser pulses are applied to the treatment site.

6. A process according to claim 1, wherein the covering layer is provided by a flow around the workpiece.

7. A process according to claim 6, wherein flowing water is used for the flow around the workpiece.

8. A process according to claim 1, wherein the first and second laser pulses are emitted by a single laser.

9. A process according to claim 1, wherein the first and second laser pulses are generated by separate lasers.

10. A process according claim 1, further comprising the step of applying the surface layer before the application of the first laser pulse by metal coating with a metal foil or an organic material.

11. A process according to claim 1, wherein the first energetic condition is the energy level of the first laser pulse and the energy level is adapted such that it leads to formation of the slightly ionized pre-plasma.

12. A process according to claim 1, wherein the second energetic condition includes a duration of the second pulse and the duration of the second laser pulse is timed so that it provides the quasi-static plasma with a high ionization.

13. A process according to claim 1, wherein the second energetic condition includes a duration of the second pulse and the energy level of the second pulse, and the energy level and duration of the second laser pulse are adapted to provide the quasi-static plasma with a high ionization.

14. A process according to claim 1, wherein the process is repeated at different treatment sites of the workpiece.

15. A system comprising:

a workpiece stressing device, at least one laser, and a control device for controlling relative movement between the workpiece after it is clamped in and the laser, the control device being adapted to form a slightly ionized pre-plasma by applying a first laser pulse, having a first energetic condition, to a treatment site of the workpiece covered by a surface layer to evaporate a portion of the surface layer and form the slightly ionized pre-plasma, form a quasi-static plasma from the slightly ionized pre-plasma by applying a second laser pulse, having a second energetic condition, wherein the second laser pulse has an energy level that is higher than an energy level of the first laser pulse, and the second laser pulse is applied to the treatment site of the workpiece at an interval of from 5 nsecs to 100 nsecs after the first laser pulse, and providing a covering layer over the treatment site during the application of the laser pulses, wherein the first energetic condition is one that forms the slightly ionized pre-plasma without forming the quasi-static plasma, wherein the first energetic condition is insufficient to form plasma and cause expansion of an unsteady plasma, and wherein the second energetic condition is one that forms the quasi-static plasma from the slightly ionized pre-plasma.

16. A process according to claim 1, wherein the first and second energetic conditions are such that laser energy is not transferred into the unsteady plasma while being expanded.

17. A system according to claim 15, wherein the first and second energetic conditions are such that laser energy is not transferred into the unsteady plasma while being expanded.

* * * * *